United States Patent [19]

Lopez

[11] 4,094,716

[45] June 13, 1978

[54] METHOD OF AND APPARATUS FOR DECORATING ARTICLES WITH DECALCOMANIAS

[75] Inventor: Eduardo Valdez Lopez, Colloto (Oviedo), Spain

[73] Assignee: Iberica de Calcomanias, S.A., Spain

[21] Appl. No.: 740,071

[22] Filed: Nov. 8, 1976

Related U.S. Application Data

[63] Continuation of Ser. No. 512,913, Oct. 7, 1974, abandoned.

[51] Int. Cl.[2] ..... B44C 1/16

[52] U.S. Cl. ..... 156/87; 156/286; 264/102; 428/914

[58] Field of Search ..... 156/63, 87, 96, 104, 156/245, 247, 249, 286–289, 293, 381, 382; 264/101, 102; 428/67, 187, 914

[56] References Cited

U.S. PATENT DOCUMENTS

| | | | |
|---|---|---|---|
| 688,302 | 12/1901 | Grether | 156/87 |
| 2,019,361 | 10/1935 | Roberts | 156/285 |
| 2,184,824 | 12/1939 | Von Hote | 156/285 |
| 2,797,180 | 6/1957 | Baldanza | 156/245 |
| 2,966,936 | 1/1961 | Schelkmann | 156/96 |
| 3,236,715 | 2/1966 | Gunderson | 156/382 |
| 3,549,446 | 12/1970 | Bennett et al. | 156/230 |
| 3,551,232 | 12/1970 | Thompson | 156/87 |
| 3,554,834 | 1/1971 | Bennett et al. | 156/230 |
| 3,697,369 | 10/1972 | Anberg et al. | 428/914 |
| 3,837,965 | 9/1974 | Mahon et al. | 156/382 |

*Primary Examiner*—William A. Powell
*Assistant Examiner*—John E. Kittle
*Attorney, Agent, or Firm*—Robert E. Burns; Emmanuel J. Lobato; Bruce L. Adams

[57] ABSTRACT

A decalcomania is prepared for transfer to an article by wetting the backing layer of the decalcomania, peeling this layer from the transfer sheet which bears the pattern, and perforating the transfer sheet at points located to minimize disturbance of the transfer sheet's pattern. The decalcomania transfer sheet is then placed over the article to which it shall be applied, and a flexible and stretchable backing sheet is placed on the decalcomania transfer sheet. Air is exhausted from below the decalcomania transfer sheet, through the perforations therein and through an aperture in the backing sheet, to draw the decalcomania transfer sheet, backed by the backing sheet, onto the article to bond the pattern to the article.

1 Claim, 2 Drawing Figures

METHOD OF AND APPARATUS FOR DECORATING ARTICLES WITH DECALCOMANIAS

This is a continuation of application Ser. No. 512,913, filed Oct. 7, 1977, now abandoned.

BACKGROUND OF THE INVENTION

This invention relates to a process of applying decorative transfers to articles, for example, ceramic, china, porcelain, or glass articles.

One process of manufacturing such articles as plates, includes operations for attaching transfers to one or both surfaces of the articles, so as to provide them with decorations and patterns.

The adaptation of transfers having patterns giving the article a substantially overall decoration has various disadvantages.

Since the transfer must be wetted to separate it from its substrate, e.g. paper, not all the water can be removed when the transfer adheres to the article, and when the article with the transfer is subjected to a heat treatment, escaping steam cracks the transfer.

NATURE OF THE INVENTION

The present invention relates to a process of applying transfers to articles of any shape which enables them to adhere quickly and continuously without any chance that the transfers will crack.

According to the invention there is provided a process of applying transfers to articles for decorative purposes, which process comprises positioning and supporting on an article having at least one bent portion, a transfer which has previously been slipped off its substrate, the transfer being trapped and held against the most projecting portions or outlines of the article, and evacuating the space bounded by the transfer and the article, whereby the transfer is drawn into contact with the article and adapts itself and completely adheres to the article.

BRIEF DESCRIPTION OF THE DRAWINGS

This invention is described more particularly with reference to the accompanying Drawings in which.

DESCRIPTION OF PREFERRED EMBODIMENTS

Figure 1:
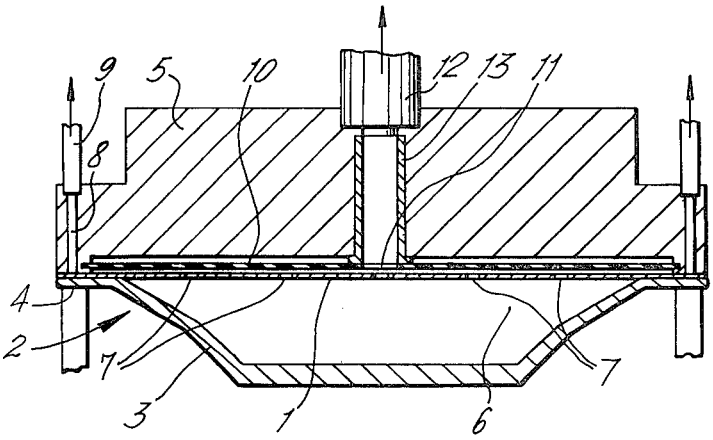
FIG. 1 and 2 illustrate diagrammatically the two main constituent phases of an embodiment according to the invention.

The process according to the invention is for the purpose of automatically, quickly and reliably applying a transfer 1 to an article illustrated as a plate, which may consist of ceramic, china, porcelain or iron or the like. The plate has a central portion 3 bent in relation to the peripheral or marginal portion 4. The transfer 1 is to occupy the whole inside surface of the article 2, so as to produce thereon a pattern or decorative motif. The pattern can occupy the whole or part of the surface.

The process starts with wetting the paper substrate on which the transfer 1 is printed, to separate the transfer from the paper. After such separation, the transfer 1 is kept stretched and as smooth as possible to position and support it on the article 2, more particularly on the peripheral portion 4, the transfer 1 being held against the peripheral portion 4 by a tool or coner 5.

Once the transfer 1 has been held against the peripheral portion 4 of the article 2, the space 6 bounded by the article 2 and the transfer 1 is evacuated. This space is completely sealed off from the outside, since the periphery of the transfer 1 is fully attached to the article 2.

A series of small orifices 7 are provided in the transfer during its actual manufacture and, as will be described hereinafter, the air is drawn off through these orifices from the space bounded by the tranfer 1 and the article 2 to be decorated.

The orifices are suitably distributed in the pattern of the transfers 1, so that they occupy blank portions of the transfers and therefore when the transfer is completely applied to the article 2, the orifices are not noticed.

The tool 5 for attaching the transfer 1 to the peripheral portion 4 of the article 2 to be decorated, has a plurality of orifices 8 distributed adjacent its periphery. The orifices 8 communicate with a tube 9 connected to a pneumatic installation.

The tool 5 has a resilient member or backing sheet 10, as a rule of rubber, formed with a central orifice 11 to which there is coupled, for example, a socket 13 adapted to move inside a central orifice in the tool 5. Connected to this central orifice is a conduit 12 which can also be connected to a pneumatic installation.

The tool 5 is completely and hermetically connected to the transfer 1 disposed on the peripheral portion 4 of the article 2 to be decorated by sucking air through the tubes 9 and the orifices 8.

Figure 2:
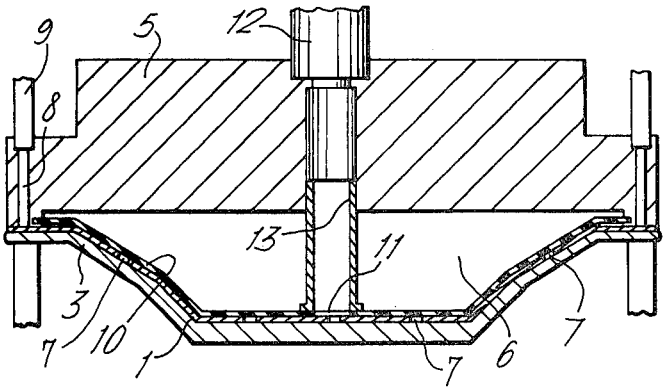

The space 6 between the article 2 and the transfer 1, more particularly the space enclosed between the resilient member 10 and the bottom or inside of the article 2 to be decorated, is evacuated by sucking air through the conduit 12, the central orifice 11 in the resilient member 10 and the orifices 7 in the transfer 1. As can be seen from FIG. 2, this evacuation determines the approach of the resilient member 10 to the surface or inner face of the article 2 to be decorated, thus enabling the transfer 1 to approach and adhere fully to the article 2, adapting itself completely to the contour thereof.

Once the transfer 1 has completely adhered to the surface of the article 2, a heat treatment is performed to complete the connecting. Heretofore, as mentioned above, steam cracked the transfer when the article with the transfer was subjected to heat, as not all the water used for wetting the transfer to separate it from its substrate can be removed; the present invention, by contrast, enables the transfers to adhere without cracking since evidently the steam, as well as the air, can escape through orifices 7. resilient member 10 has further advantage that the orifices 7 through which the air is evacuated are adequately distributed over the whole surface of the transfer 1, more particularly at zones or places which are not patterned, so that such orifices are not noticed once the process of applying the transfer 1 has been completed.

The applying of the transfer leads to the production of articles with decorative patterns, which can occupy the whole or part of the article, rapidly and with a considerable output. The process of the invention can be used even for articles having irregular outlines, to which the transfer 1 fully adapts itself. In other automatic or manual processes, complete adaptation can be achieved only by laborious and costly methods, if at all.

The pattern of the transfer 1 can occupy the whole surface of the article 2 or be divided up and distributed in portions as desired, although the transfer itself must have an integral surface (apart from orifices 7) in order for it to be completely connected to the ceramic article 2. Sometimes, and in certain articles which are difficult to make, the transfer 1 can be connected not only at the periphery but at or near the centre. Even partial transfers can be connected to the ceramic article by drawing off the air.

What we claim is:

1. A method of decorating an article with a decalcomania, comprising;

perforating a decorative transfer;

wetting the perforated decalcomania transfer to remove it from a substrate thereof;

backing the wetted transfer by a flexible backing sheet stronger than the transfer to hold the transfer, backed by the backing sheet, over a surface portion of an article such as a ceramic plate, which surface portion is to be decorated with the transfer, while holding a marginal portion of the backing sheet to a marginal portion of the article surrounding the surface portion, to define an enclosed space by and between the article and the backing sheet, the backing sheet having an aperture in the enclosed space, and to hold the wetted perforated transfer in the enclosed space between the backing sheet and the article;

exhausting air from the enclosed space through the perforated transfer and the aperture of the backing sheet for drawing the transfer, backed by the flexible backing sheet, firmly onto the surface portion of the article, to bond the transfer to the article;

subjecting the article with the wetted perforated bonded transfer to heat, and permitting any resulting steam to escape through the perforated transfer to prevent cracking of the transfer.

* * * * *